US007163371B2

(12) United States Patent
Higashida

(10) Patent No.: US 7,163,371 B2
(45) Date of Patent: Jan. 16, 2007

(54) CENTRIFUGAL FAN

(75) Inventor: Masashito Higashida, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 112 days.

(21) Appl. No.: 10/517,143

(22) PCT Filed: Apr. 28, 2004

(86) PCT No.: PCT/JP2004/005661

§ 371 (c)(1),
(2), (4) Date: Dec. 7, 2004

(87) PCT Pub. No.: WO2004/099625

PCT Pub. Date: Nov. 18, 2004

(65) Prior Publication Data

US 2005/0226721 A1 Oct. 13, 2005

(30) Foreign Application Priority Data

May 9, 2003 (JP) ..... 2003-131719
Aug. 25, 2003 (JP) ..... 2003-299857

(51) Int. Cl.
*F04D 29/44* (2006.01)
*F04D 29/28* (2006.01)

(52) U.S. Cl. ..... 415/204; 415/228

(58) Field of Classification Search ..... 415/203, 415/204, 205, 228; 416/189
See application file for complete search history.

(56) References Cited

U.S. PATENT DOCUMENTS 5,813,831 A 9/1998 Matsunaga et al.
6,299,409 B1 10/2001 Matsunaga et al.

FOREIGN PATENT DOCUMENTS

| | | | |
|---|---|---|---|
| CN | 1395046 | A | 2/2003 |
| EP | 1411247 | A | 4/2004 |
| JP | 53-36711 | A | 4/1974 |
| JP | 57-178199 | U | 11/1982 |
| JP | 59-112000 | U | 11/1982 |
| JP | 63-80097 | A | 4/1988 |
| JP | 2-039593 | U | 3/1990 |
| JP | 2-039595 | U | 8/1990 |
| JP | 7-063195 | A | 3/1995 |
| JP | 9-209994 | A | 8/1997 |
| JP | 9-242696 | A | 9/1997 |
| JP | 2000-291590 | A | 10/2000 |
| JP | 2003-013888 | A | 1/2003 |

*Primary Examiner*—Edward K. Look
*Assistant Examiner*—Nathan Wiehe
(74) *Attorney, Agent, or Firm*—Global IP Counselors

(57) ABSTRACT

A centrifugal fan is configured to be capable of preventing turbulence of the flow in the vicinity of an inlet. The centrifugal fan is a multi blade fan that takes gas in from a rotational axis line direction and blows the gas out in a direction that intersects the rotational axis line, and comprises an impeller and a bell mouth. The impeller rotates about the rotational axis line. The bell mouth has an inlet arranged so that it opposes the impeller, and a recessed part around the inlet that forms a recessed negative pressure space facing the impeller side, and guides the inlet gas to the impeller.

23 Claims, 14 Drawing Sheets

CENTRIFUGAL FAN

TECHNICAL FIELD

The present invention relates to a centrifugal fan, and more particularly relates to a centrifugal fan that takes in a gas from a rotational axis direction, and blows out the gas in a direction that intersects the rotational axis.

BACKGROUND ART

Centrifugal fans are used for ventilation in air cleaners, air conditioners, and the like. FIG. 1 and FIG. 2 depict one conventional example of a centrifugal fan called a multi blade fan. Further, FIG. 1 depicts a side view (specifically, a cross sectional view taken along A—A in FIG. 2) of a conventional example of a multi blade fan, and FIG. 2 depicts a plan view of a conventional example of a multi blade fan.

A multi blade fan 10 comprises an impeller 13, a housing 11 that houses the impeller 13, a motor 14 for rotating the impeller 13, and the like. Further, the axis O—O in FIG. 1 and FIG. 2 is the rotational axis line of the impeller 13 and the motor 14.

One end of each of numerous blades 33 (only some of the numerous blades 33 are illustrated in FIG. 2) of the impeller 13 are fixed to the outer circumferential edge of a discoidal main plate 31, and the other end of each of these blades 33 are connected by an annular side plate 32.

The housing 11 is a scroll shaped box body when viewed from a plan perspective, and comprises an opening 11*a* and a gas outlet 11*b*.

A bell mouth 12 is arranged so that it covers the opening 11*a* of the housing 11, and an inlet 12*a* is formed therein for guiding the inlet gas to the impeller 13. The inlet 12*a* is arranged so that it opposes the side plate 32 of the impeller 13. The bell mouth 12 comprises a curved part 12*b* that extends on inner circumferential edge of the inlet 12*a* toward the impeller 13 side, and a flat part 12*c* formed so that it covers the opening 11*a* on an outer circumferential side of the curved part 12*b* in the radial direction and that extends in a direction that intersects a rotational axis line O—O.

If the multi blade fan 10 is operated by driving the motor 14, then the impeller 13 rotates oriented in the rotational direction R in FIG. 2 with respect to the housing 11. Thereby, all of the blades 33 of the impeller 13 raise the pressure of and blow out the gas from the space on the inner circumferential side to the space on the outer circumferential side, take gas from the inlet 12*a* into the space on the inner circumferential side of the impeller 13, and collect and blow out to the outlet 11*b* the gas that was blown out to the outer circumferential side of the impeller 13. In other words, as shown by the arrow W depicted in FIG. 1 and FIG. 2, the multi blade fan 10 principally takes in gas from the rotational axis line O—O direction and blows out gas from the outlet 11*b*.

Patent Document 1

Japanese Published Patent Application No. H09-209994

SUMMARY OF THE INVENTION

In such a multi blade fan 10, turbulence in the flow of the gas in the vicinity of the inlet 12*a* causes an increase in noise and a decrease in ventilation performance. The following are types of turbulence in the flow of gas in the vicinity of the inlet 12*a*.

(1) Turbulence in the Flow of Gas Flowing into the Inlet 12*a* Along the Bell Mouth (Wall Surface Flow)

As shown by the arrow X in FIG. 1, turbulence in the flow is generated if the flow of gas taken from the outer circumferential side of the housing along the flat part 12*c* of the bell mouth 12 into the inlet 12*a* (wall surface flow X) breaks away in the vicinity of the curved part 12*b* and no longer travels along the bell mouth 12.

(2) Turbulence in a Turning Flow in the Vicinity of the Side Plate 32 of the Impeller 13

As shown by the arrow Y in FIG. 1, a turning flow is generated wherein, inside the impeller 13, a portion of the gas that flows inside the housing 11 is blown out to the outer circumference of the impeller 13 in the vicinity of the side plate 32, and is then once again taken from the vicinity of the bell mouth 12 of the impeller 13 into the inner circumferential side of the impeller 13. Turbulence in the flow is generated if this turning flow does not flow smoothly toward the inner circumferential side of the impeller 13.

(3) Turbulence Due to the Merging of the Wall Surface Flow X and a Turning Flow Y The wall surface flow X and the turning flow Y merge inside the impeller 13, but turbulence in the flow is generated at this time by the merging. Furthermore, if turbulence in the flow is generated in the wall surface flow X and the turning flow Y, then turbulence in the flow when merging is greater.

(4) Turbulence Due to Merging of the Wall Surface Flow X and the Main Flow (Arrow W)

In a model centrifugal fan that takes in air from the axial direction, the line of flow of the wall surface flow X is generally orthogonal to the line of flow of the main flow (refer to arrow W) that flows from the rotational axis direction into the inlet 12*a*, and turbulence in the flow is consequently generated when the wall surface flow X merges into the main flow W.

Incidentally, there is a demand for reduced noise and enhanced performance with multi blade fans used in air cleaners, air conditioners, and the like. In addition, the increased noise and reduced ventilation performance caused by turbulence in the flow in the vicinity of the inlet, as described above, is not limited to multi blade fans, but is shared with centrifugal fans, including radial fans, turbo fans, and the like.

It is an object of the present invention to provide a centrifugal fan capable of preventing turbulence in the flow in the vicinity of the inlet.

The centrifugal fan according to the first aspect of the present invention is a centrifugal fan that takes in gas from a rotational axis direction and blows the gas out in a direction that intersects the rotational axis, comprising an impeller and a bell mouth. The impeller rotates about the rotational axis. The bell mouth has an inlet arranged so that it opposes the impeller, and a recessed part that forms a recessed negative pressure space around the inlet facing the impeller side, and that guides the inlet gas to the impeller.

In this centrifugal fan, a negative pressure space is formed by providing a recessed part around the inlet of the bell mouth, and the flow of gas that flows into the inlet along the bell mouth (the wall surface flow) is drawn into this space when it passes through the vicinity of the recessed part; as a result, the wall surface flow flows along the bell mouth without breaking away. Thereby, turbulence in the flow in the vicinity of the inlet can be reduced, enabling a reduction in noise and an improvement in the ventilation performance.

The centrifugal fan according to the second aspect of the present invention is the centrifugal fan according to the first aspect of the present invention, wherein the bell mouth has a flat part and a curved part. The flat part extends on the outer circumferential side of the recessed part in the radial direction in a direction that intersects the rotational axis. The curved part extends on the inner circumferential side of the recessed part in the radial direction toward the impeller side, and forms the inlet. The portion of the recessed part that is most recessed on the impeller side is positioned on the impeller side of a connecting portion between the flat part and the recessed part, and is positioned on the impeller side of a connecting portion between the curved part and the recessed part.

In this centrifugal fan, the portion of the recessed part that is most recessed on the impeller side is positioned on the impeller side of the connecting portion between the flat part and the recessed part, and is positioned on the impeller side of the connecting portion between the curved part and the recessed part; consequently, the negative pressure space formed by the provision of the recessed part can reliably be set to a negative pressure state.

The centrifugal fan according to the third aspect of the present invention is the centrifugal fan according to the second aspect of the present invention, wherein the ratio of a length from the center of the rotational axis to the connecting portion between the flat part and the recessed part with respect to an outer radius of the impeller, i.e., a length ratio, is greater than or equal to 0.8 and less than 1.4.

For example, if the abovementioned length ratio is set to less than 0.8, then the radial distance between the recessed part and the inlet would be small and, consequently, the wall surface flow would unfortunately arrive at the inlet before sufficiently obtaining the function of suppressing the breaking away of the wall surface flow by the recessed part. However, if the abovementioned length ratio is set to greater than 1.4, the radial distance between the recessed part and the inlet would be large and, consequently, the wall surface flow whose breaking away was once suppressed would unfortunately arrive at the inlet in a state wherein it once again began to break away.

Thus, in this centrifugal fan, arranging the recessed part at an appropriate radial position according to the size of the outer diameter of the impeller enables the function that suppresses the breaking away of the wall surface flow due to the formation of the recessed part to be accomplished as an advantageous effect of reliably reducing turbulence in the flow in the vicinity of the inlet.

The centrifugal fan according to the fourth aspect of the present invention is the centrifugal fan according to the second aspect of the present invention or the third aspect of the present invention, wherein an angle formed in the connecting portion between the flat part and the recessed part by a plane formed on the side opposite the impeller by virtually extending the flat part to the inner circumferential side and the surface extending from the portion of the recessed part that is most recessed on the impeller side to the connecting portion between the flat part and the recessed part is greater than 60° and less than 90°.

For example, if the abovementioned angle is set to less than 60°, then the pressure tends not to vary precipitously when the wall surface flow flows from the flat part to the recessed part, making it difficult to obtain sufficiently the function of suppressing the breaking away of the wall surface flow. However, if the abovementioned angle is set to greater than 90°, then it only adds space that does not for the most part contribute as negative pressure space, and reduces the contribution to the improvement of the function of suppressing of the breaking away of the wall surface flow; in addition, dye cutting is difficult when such a bell mouth is formed from resin, and the like.

Thus, in this centrifugal fan, setting the angle between the flat part and the surface proceeding from the flat part to the recessed part to an appropriate angular range enables the function that suppresses the breaking away of the wall surface flow due to the formation of the recessed part, achieving an advantageous effect of reliably reducing turbulence in the flow in the vicinity of the inlet.

The centrifugal fan according to the fifth aspect of the present invention is the centrifugal fan according to any one invention of the second through fourth aspects of the present invention, wherein the plane formed on the side opposite the impeller by virtually linking the connecting portion between the flat part and the recessed part with the connecting portion between the curved part and the recessed part is substantially orthogonal to the rotational axis.

In this centrifugal fan, the plane formed on the side opposite the impeller by virtually linking the connecting portion between the flat part and the recessed part with the connecting portion between the curved part and the recessed part is substantially orthogonal to the rotational axis, and the flow of the gas is not disturbed when it passes through the vicinity of the recessed part.

The centrifugal fan according to the sixth aspect of the present invention is the centrifugal fan as recited in anyone of the second through fifth aspects of the present invention, wherein the bell mouth further has a plurality of protruding parts arranged in the connecting portion between the curved part and the recessed part and aligned spaced apart in the circumferential direction of the inlet, and that protrude outward on the impeller side of the connecting portion between the curved part and the recessed part.

In this centrifugal fan, a plurality of protruding parts are formed in the connecting portion between the curved part and the recessed part of the bell mouth, i.e., on the downstream side of the flow of the recessed part. In so doing, after the wall surface flow passes through the vicinity of the recessed part, a portion flows along the protruding parts, and the remaining flows as is along the curved part between the protruding parts. Furthermore, because the line of flow of the gas that flows along the protruding parts substantially coincides with the line of flow of the main flow, it merges smoothly with the main flow without producing any turbulence. However, the gas that flows along the curved part merges with the main flow that merged with the gas that flows along the protruding parts, and flows into the inlet. Herein, the flow rate of the gas that flows along the curved part is less than the case wherein the protruding parts are not formed, consequently mitigating turbulence in the flow due to the merging with the main flow.

Thereby, turbulence in the flow in the vicinity of the inlet is further reduced, enabling a reduction in noise and an improvement in the ventilation performance.

The centrifugal fan according to the seventh aspect of the present invention is the centrifugal fan according to the sixth aspect of the present invention, wherein a portion of the protruding parts that protrude most on the side opposite the impeller is positioned more on the side opposite the impeller than a connecting portion between the flat part and the recessed part.

In this centrifugal fan, the portion of the protruding parts that protrude most on the side opposite the impeller are positioned more on the side opposite the impeller than the connecting portion between the flat part and the impeller, and a portion of the wall surface flow can consequently be reliably guided to the protruding parts side.

The centrifugal fan according to the eighth aspect of the present invention is the centrifugal fan according to anyone of the first through seventh aspects of the present invention, wherein the recessed part is annularly formed so that it surrounds the inlet.

In this centrifugal fan, the recessed part is annularly formed so that it surrounds the inlet, consequently enabling the achievement of the advantageous effect that causes gas to flow along the bell mouth to the wall surface flow from the entire circumference of the inlet, thus reducing turbulence in the flow in the vicinity of the inlet and enabling a reduction in noise and an improvement in the ventilation performance.

The centrifugal fan according to the ninth aspect of the present invention is the centrifugal fan according to anyone of the first through eighth aspects of the present invention, wherein the impeller has a main plate, a plurality of blades, and an annular side plate. The main plate rotates about the rotational axis. The blades are annularly arranged about the rotational axis, and end parts thereof on the side opposite the inlet are each fixed to the main plate. The side plate connects with the end parts on the inlet side of the plurality of blades. The surface of the recessed part on the impeller side has a shape that follows along the side plate.

In this centrifugal fan, the surface of the recessed part on the impeller side has a shape that follows along the side plate, consequently reducing turbulence in the wall surface flow, reducing turbulence in the turning flow in the vicinity of the side plate, and enabling a reduction in the noise caused by turbulence in the turning flow.

The centrifugal fan according to the tenth aspect of the present invention is the centrifugal fan according to the ninth aspect of the present invention, wherein the end part of the curved part on the impeller side is arranged on the inner circumferential side in the radial direction of the end part of the side plate on the inlet side, and is arranged so that it overlaps in the rotational axis direction the end part of the side plate on the inlet side.

In this centrifugal fan, the end part of the curved part on the impeller side and the end part of the side plate on the inlet side are arranged so that they overlap at a position on the inner circumferential side of the side plate in the radial direction; consequently, the wall surface flow and the turning flow merge smoothly, enabling a further reduction in noise.

The centrifugal fan according to the eleventh aspect of the present invention is the centrifugal fan according to anyone of the first through eighth aspects of the present invention, further provided with a scroll shaped housing having an opening formed so that it opposes the impeller, and an outlet formed on the outer circumferential side, and that houses the impeller. The bell mouth is provided so that the inlet opposes the opening of the housing.

In this centrifugal fan, the portion of the housing where the axial dimension decreases is limited only to the portion where the recessed part is provided, and the volume of the space inside the housing is consequently ensured.

The centrifugal fan according to the twelfth aspect of the present invention is the centrifugal fan according to the ninth aspect of the present invention or the tenth aspect of the present invention, further provided with a scroll shaped housing having an opening formed so that it opposes the impeller, and a gas outlet formed on the outer circumferential side, and that houses the impeller. The bell mouth is provided so that the inlet opposes the opening of the housing. Further, interblade parts positioned between each of the plurality of blades of the main plate are cut out at least at the blade front part in the rotational direction of the blades.

In this centrifugal fan, interblade parts positioned between each of the plurality of blades of the main plate are cut out at least at the blade front part in the rotational direction of the blades, and gas consequently flows also to the gap between the main plate and the housing through this interblade part. Thereby, it is possible to take sufficient advantage of the volume of the space of the housing.

DETAILED DESCRIPTION OF THE PREFERRED EMBODIMENTS

The following explains the embodiments of the multi blade fan (centrifugal fan) according to the present invention, using the drawings.

First Embodiment (1) Constitution of the Multi Blade Fan

Figure 3:
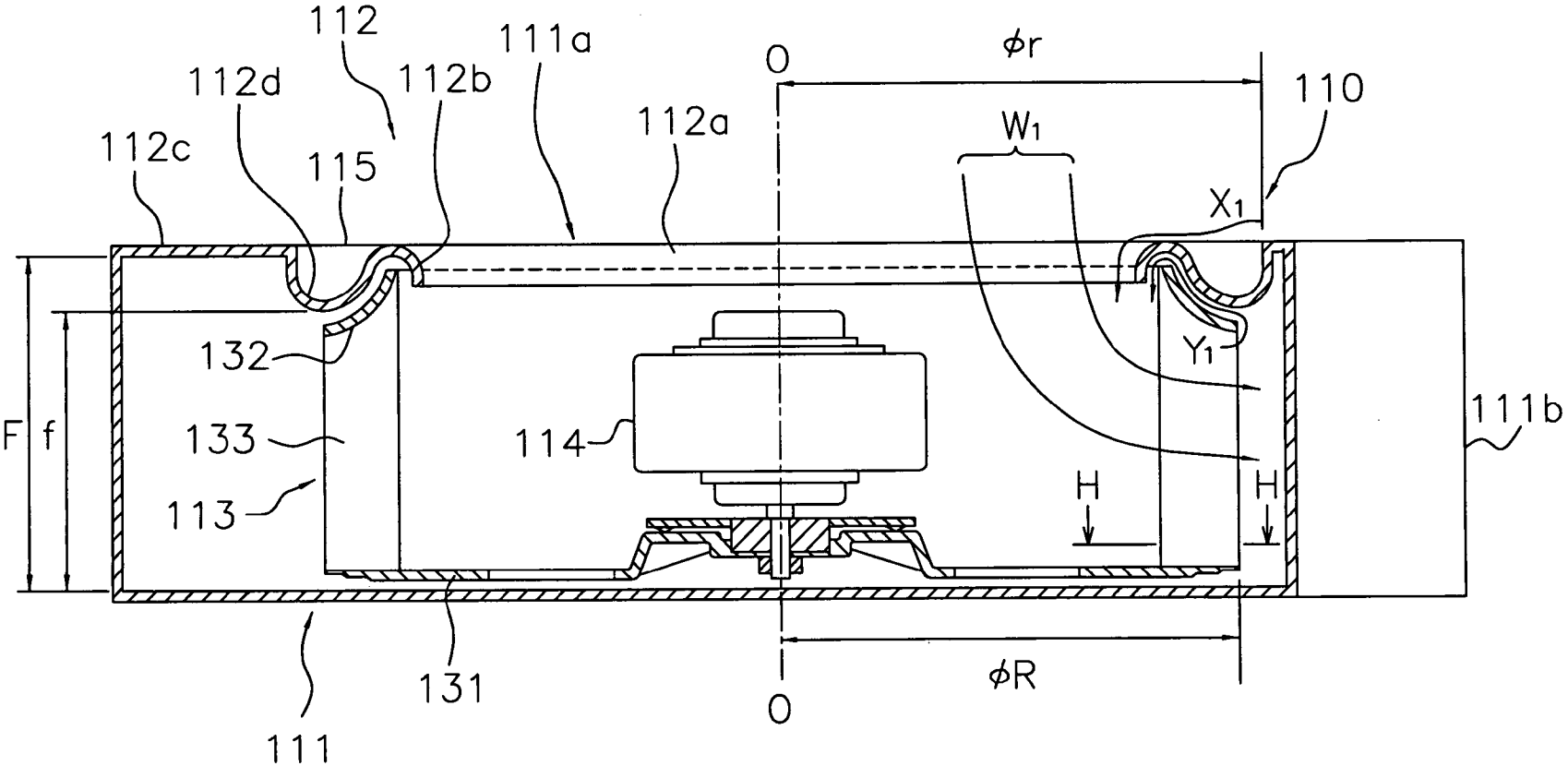
FIG. 3 is a side view (cross sectional view taken along A—A in FIG. 4) of the multi blade fan according to the first embodiment of the present invention.

FIG. 3 depicts a multi blade fan 110 according to the first embodiment of the present invention. Further, FIG. 3 is a side view (specifically, a cross sectional view taken along A—A in FIG. 4) of the multi blade fan 110 according to the first embodiment of the present invention, and FIG. 4 is a plan view of the multi blade fan 110.

The same as the conventional example of the multi blade fan 10 (refer to FIG. 1 and FIG. 2), the multi blade fan 110 comprises an impeller 113, a housing 111 that houses the impeller 113, a motor 114 for rotating the impeller 113, and the like. Further, the axis O—O in FIG. 3 and FIG. 4 is the rotational axis line of the impeller 113 and the motor 114.

Figure 4:
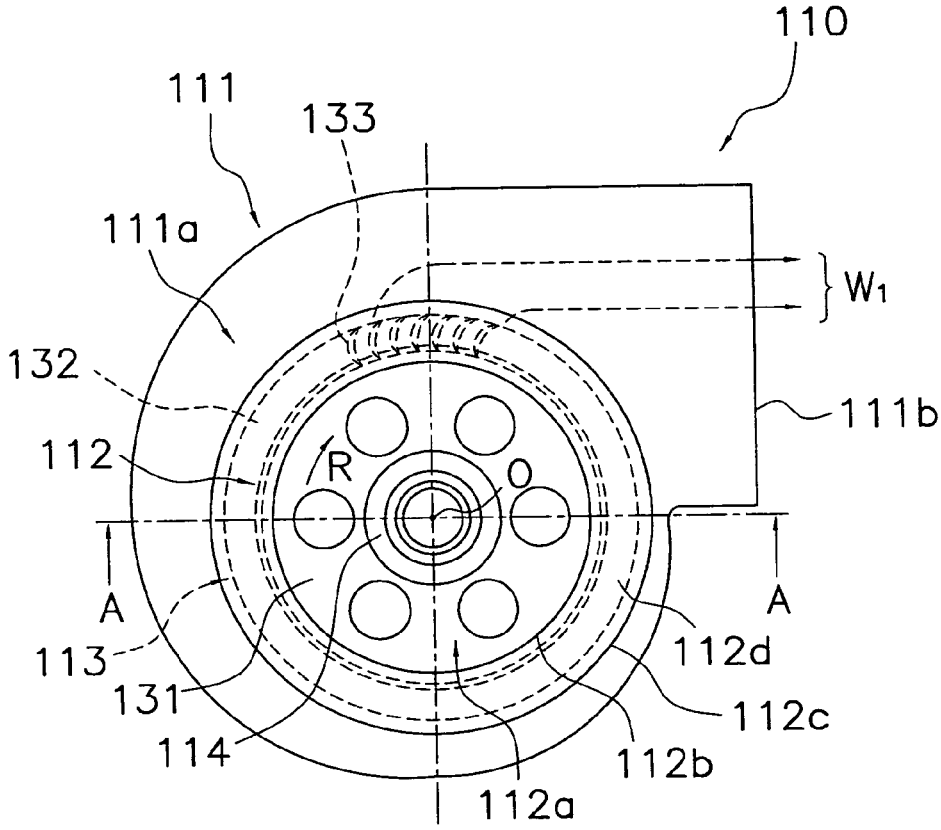
FIG. 4 is a plan view of the multi blade fan according to the first embodiment of the present invention.

One end of each of numerous blades 133 (only some of the numerous blades 133 are illustrated in FIG. 4) of the impeller 113 is fixed to the outer circumferential edge of a discoidal main plate 131, and the other end of each of those blades 133 is connected by an annular side plate 132. Furthermore, in the present embodiment, the shape of the side plate 132 differs from the shape of the side plate 32 of the conventional example of the multi blade fan 10. Specifically, the side plate 132 is an annular member inclined toward the side opposite the main plate 131 (namely, the side of an inlet 112*a*, discussed later) when proceeding from the outer circumferential edge to the inner circumferential edge.

The same as in the conventional multi blade fan 10, the housing 111 is a scroll shaped box body from a plan perspective, and comprises an opening 111*a*, and a gas outlet 111*b*. In addition, the motor 114 in the present embodiment is arranged in a space on the inner circumferential side of the impeller 113, and is supported by the housing 111 via a support member (not shown).

A bell mouth 112 is arranged so that it covers the opening 111*a* of the housing 111, and the inlet 112*a* is formed therein for guiding the inlet gas to the impeller 113. The inlet 112*a* is arranged so that it opposes the side plate 132 of the impeller 113. Furthermore, in the present embodiment, the bell mouth 112 has a shape different from that of the bell mouth 12 of the conventional example of the multi blade fan 10, and comprises a recessed part 112*d* around the inlet 112*a* that is recessed toward the impeller 113 side. Specifically, the bell mouth 112 comprises a curved part 112*b* that extends on the inner circumferential edge of the inlet 112*a* toward the impeller 113 side, a recessed part 112*d* formed on the outer circumferential side in the radial direction of the curved part 112*b*, and a flat part 112*c* formed on the outer circumferential side in the radial direction of the recessed part 112*d* so that it covers the opening 111*a* and that extends in a direction that intersects the rotational axis line O—O. In addition, the recessed part 112*d* is annularly formed so that it surrounds the inlet 112*a*.

Figure 5:
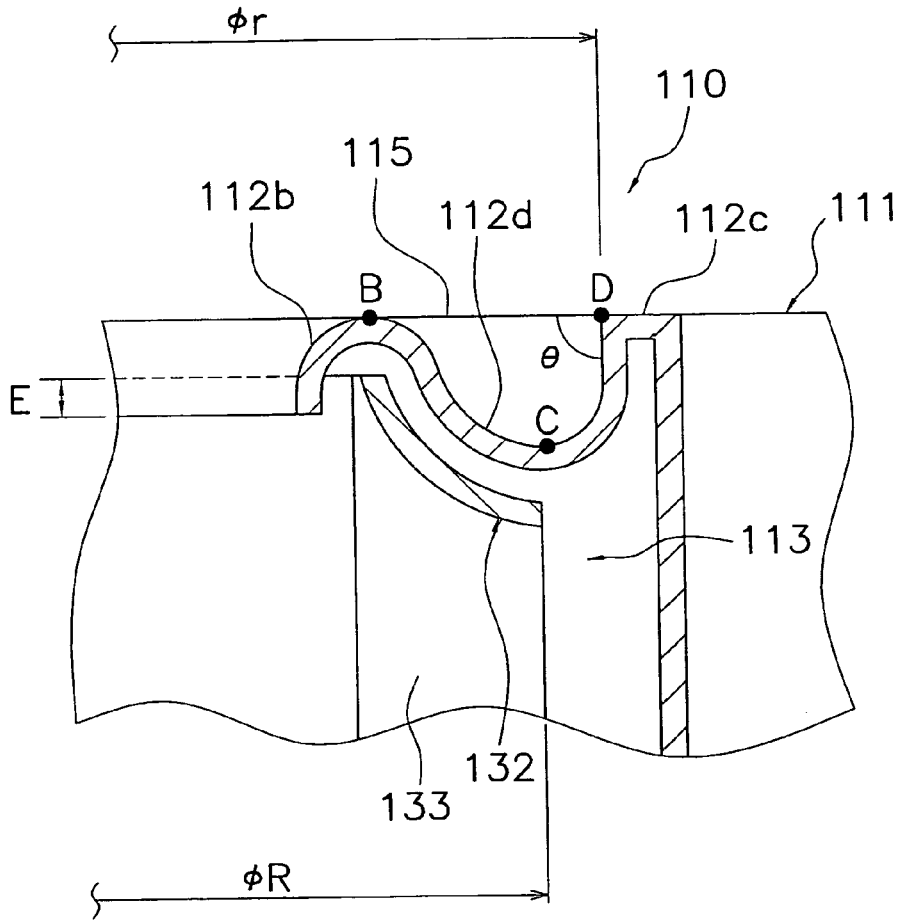
FIG. 5 is an enlarged view of FIG. 3, and depicts the vicinity of the recessed part of the bell mouth of the multi blade fan.

The following explains the details of the structure in the vicinity of the recessed part 112*d* of the bell mouth 112 of the multi blade fan 110, using FIG. 5. Further, FIG. 5 is an enlarged view of FIG. 3, and depicts the vicinity of the recessed part 112*d* of the bell mouth 112 of the multi blade fan 110.

Herein, if we let the connecting portion between the curved part 112*b* and the recessed part 112*d* (in detail, the surface of this portion on the side opposite the impeller 113) be point B, the portion of the recessed part 112*d* that is most recessed on the impeller 113 side (in detail, the surface of this portion on the side opposite the impeller 113) be point C, and the connecting portion between the flat part 112*c* and the recessed part 112*d* (in detail, the surface of this portion on the side opposite the impeller 113) be point D, then the point C is positioned on the impeller 113 side of the point B and the point D.

In addition, in the present embodiment, the ratio of the length $\phi r$, from the rotational axis line O—O to the point D with respect to the outer radius $\phi R$ of the impeller 113, i.e., the length ratio $\phi r/\phi R$, is greater than or equal to 0.8 and less than 1.4.

In addition, in the present embodiment, a plane 115 formed by virtually linking the point B and the point D is substantially orthogonal to the rotational axis line O—O, and is positioned in a plane identical to the surface of the flat part 112*c* on the side opposite the impeller 113. Consequently, the flow of the gas when passing through the vicinity of the recessed part 112*d* (the wall surface flow) is such that it does not become turbulent.

In addition, the angle $\theta$ formed at the point D by the plane formed on the side opposite the impeller 113 by virtually extending the flat part 112*c* to the inner circumferential side (in the present embodiment, the plane the same as the plane 115) and the plane extending from the point C to the point D is greater than 60° and less than 90°.

In addition, the surface on the impeller 113 side of the recessed part 112*d* of the bell mouth 112 (particularly the surface corresponding to that between the point B and the point C) has a shape that follows along the shape of the side plate 132. In other words, by forming the recessed part 112*d* in the bell mouth 112, the shape that follows along the side plate 132 is formed in the bell mouth 112.

Furthermore, the end part of the impeller 113 side of the curved part 112*b* of the bell mouth 112 is arranged on the inner circumferential side in the radial direction of the end part on the inlet 112*a* side of the side plate 132, and is arranged so that it overlaps the end part on the inlet 112*a* side of the side plate 132 in the rotational axis line O—O direction (refer to E in FIG. 5).

Furthermore, in the multi blade fan 110 of the present embodiment, the portion of the axial dimension F (refer to FIG. 3) of the housing 111 that decreases is limited only to the portion where the recessed part 112*d* is provided (refer to f in FIG. 3) and the portion where the volume of the space inside the housing 111 decreases is therefore as small as possible.

(2) Operation of the Multi Blade Fan

Figure 6:
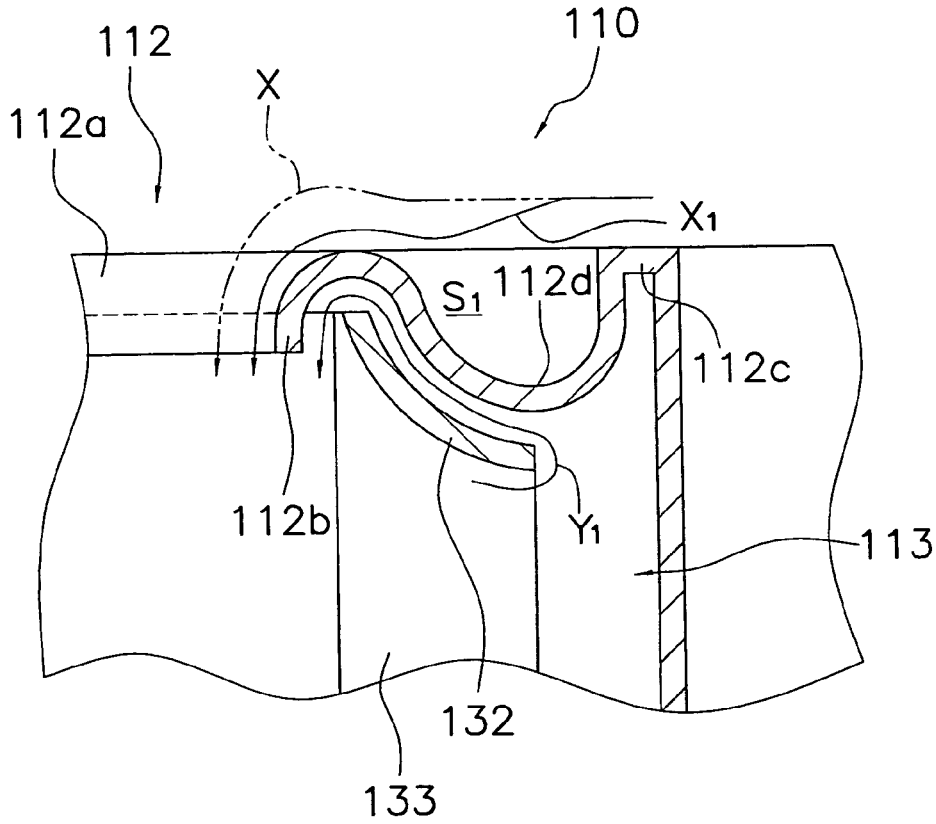
FIG. 6 is an enlarged view of FIG. 3, and explains the wall surface flow and the turning flow in the vicinity of the recessed part of the bell mouth.

The following explains the operation of the multi blade fan 110, using FIG. 3, FIG. 4, and FIG. 6. Further, FIG. 6 is an enlarged view of FIG. 3, and explains the wall surface flow and the turning flow in the vicinity of the recessed part 112*d* of the bell mouth 112.

If the multi blade fan 110 is operated by driving the motor 114, then the impeller 113 rotates oriented in the rotational direction R in FIG. 4 with respect to the housing 111. Thereby, all of the blades 133 of the impeller 113 raise the pressure of and blow out the gas from the space on the inner circumferential side to the space on the outer circumferential side, take gas from the inlet 112*a* into the space on the inner circumferential side of the impeller 113, and collect and blow out the gas blown out to the outer circumferential side of the impeller 113 into the outlet 111*b*. Namely, the same as the conventional multi blade fan 10, the multi blade fan 110 principally takes in gas from the rotational axis O—O direction and blows out gas from the outlet 111*b*, as shown by the arrow $W_1$ depicted in FIG. 3 and FIG. 4.

Further, the wall surface flow and the turning flow of the gas in the vicinity of the inlet 112*a* of the bell mouth 112 are as shown in FIG. 3 and FIG. 6.

When the gas of the wall surface flow (the arrow $X_1$ in the figure) passes through the vicinity of the recessed part 112*d*, the space formed by the provision of the recessed part 112*d* (the symbol $S_1$ in FIG. 6) changes to negative pressure, and the wall surface flow thereby is drawn into this space $S_1$; as a result, the flow does not break away as in the conventional wall surface flow (chain double dashed arrow X in the figure), and the wall surface flow flows along the bell mouth 112. Thereby, turbulence in the flow in the vicinity of the inlet 112*a* is reduced, thus achieving a reduction in noise and an improvement in the ventilation performance.

Moreover, in the multi blade fan 110, the point C of the recessed part 112*d* is positioned more on the impeller 113 side than the point D, and is positioned more on the impeller 113 side than the point B, thus enabling the reliable creation of negative pressure in the space $S_1$.

In addition, in the multi blade fan 110 as shown in FIG. 5, the ratio of the length φr from the rotational axis line O—O to the point D with respect to the outer radius φR of the impeller 113, i.e., the length ratio φr/φR, is greater than or equal to 0.8 and less than 1.4. Therein, if the length ratio φr/φR is, for example, less than 0.8, then the radial distance between the recessed part 112*d* and the inlet 112*a* is reduced, and the wall surface flow consequently unfortunately arrives at the inlet 112*a* before the function of suppressing the breaking away of the wall surface flow due to the recessed part 112*d* can be sufficiently obtained. However, if the length ratio φr/φR is increased beyond 1.4, then the radial distance between the recessed part 112*d* and the inlet 112*a* increases, and the wall surface flow that was once suppressed from breaking away unfortunately arrives at the inlet 112*a* in a state wherein it once again begins to break away. Thus, in this multi blade fan 110, arranging the recessed part 112*d* at an appropriate radial position according to the size of the outer diameter of the impeller 113 enables the function that suppresses the breaking away of the wall surface flow due to the formation of the recessed part 112*d* to be fully accomplished as an advantageous effect of reliably reducing turbulence in the flow in the vicinity of the inlet 112*a*.

In addition, in the multi blade fan 110 as shown in FIG. 5, the angle θ formed at the point D by the plane 115, which is formed on the side opposite the impeller 113 by virtually extending the flat part 112*c* to the inner circumferential side, and the surface extending from the point C to the point D is greater than 60° and less than 90°. Therein, for example, if the angle θ is less than or equal to 60°, then a precipitous change in pressure tends not to occur when the wall surface flow flows from the flat part 112*c* toward the recessed part 112*d*, thereby making it difficult to sufficiently obtain the advantageous effect of suppressing the breaking away of the wall surface flow. However, if the angle θ is made greater than 90°, then the space that largely does not contribute as the negative pressure space only increases, thus decreasing the contribution to the improvement of the function that suppresses the breaking away of the wall surface flow; further, die cutting is also difficult when forming such a bell mouth 112 from resin, and the like. Thus, in this multi blade fan 110, setting the angle θ between the surfaces that face the flat part 112*c* and the recessed part 112*d* to an appropriate angular range enables the function that suppresses the breaking away of the wall surface flow due to the formation of the recessed part 112*d* as an advantageous effect of reliably reducing turbulence in the flow in the vicinity of the inlet 112*a*.

In addition, the recessed part 112*d* is annularly formed so that it surrounds the inlet 112*a*, consequently enabling the advantageous effect wherein the wall surface flow from the entire circumference of the inlet 112*a* is made to flow along the bell mouth 112.

In addition, inside the housing 111, the turning flow, wherein the gas blown out to the outer circumference of the impeller 113 passes through the passageway between the bell mouth 112 and the side plate 132 in the axial direction and is taken in once again to the inner circumferential side of the impeller 113 (the arrow $Y_1$ in the figure) can flow more smoothly toward the inner circumferential side of the impeller 113 because the recessed part 112*d* is formed in the bell mouth 112, and because the surface of the recessed part 112*d* on the impeller 113 side has a shape that follows along the side plate 132. Thereby, turbulence in the wall surface flow is reduced, turbulence in the turning flow in the vicinity of the side plate 132 is reduced, and the noise caused by turbulence in the turning flow is reliably reduced.

Furthermore, because the end part on the impeller 113 side of the curved part 112*b* and the end part on the inlet 112*a* side of the side plate 132 are arranged so that they overlap at a position on the inner circumferential side of the side plate 132, both the wall surface flow $X_1$ and the turning flow $Y_1$ can flow in the axial direction of the impeller 113 toward the main plate 131 side, and the wall surface flow $X_1$ and the turning flow $Y_1$ merge smoothly. Thereby, turbulence in the flow due to the merging of the wall surface flow $X_1$ and the turning flow $Y_1$ is also reduced, thereby reducing the noise caused by the merging of the wall surface flow $X_1$ and the turning flow $Y_1$.

(3) Experimental Example

Figure 7:
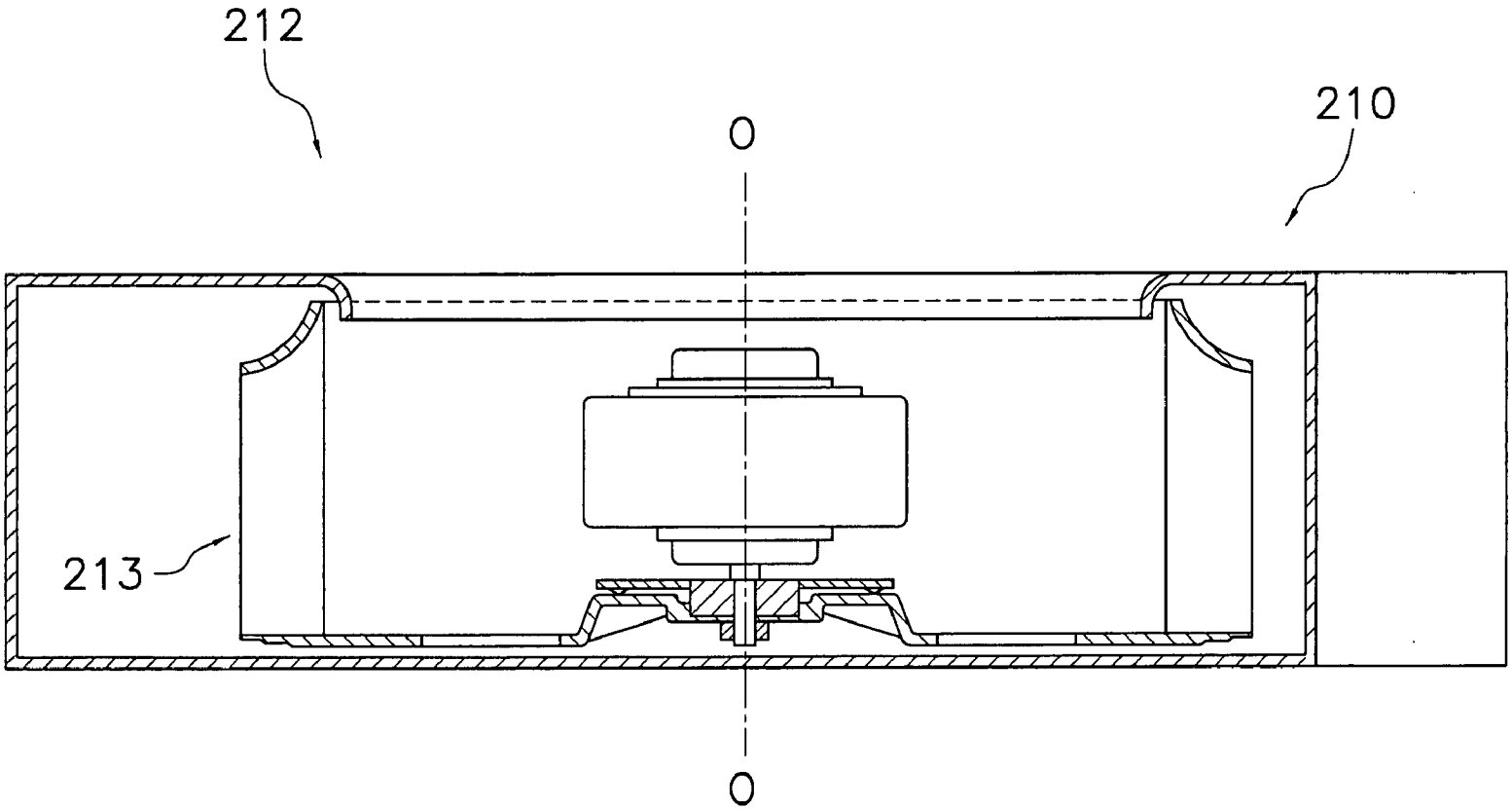
FIG. 7 is a side view of the multi blade fan for the purpose of comparing performance, and corresponds to FIG. 3.

To confirm the advantageous effects of the present invention, the following experiment was conducted to determine how the presence of the recessed part 112*d* of the bell mouth 112 in the multi blade fan 110 of the present embodiment affects noise performance and ventilation performance. Therein, a multi blade fan 210 comprising an impeller 213 the same as the impeller 113 and a bell mouth 212 without a recessed part 112*d* was prepared, as shown in FIG. 7, as a multi blade fan for comparing performance with the multi blade fan 110 of the present embodiment. In addition, with regard to the size of the impeller used in the experiment, the outer diameter of the impeller was 260 mm, and the width of the impeller was 70 mm, for both the impeller 113 and the impeller 213.

Figure 8:
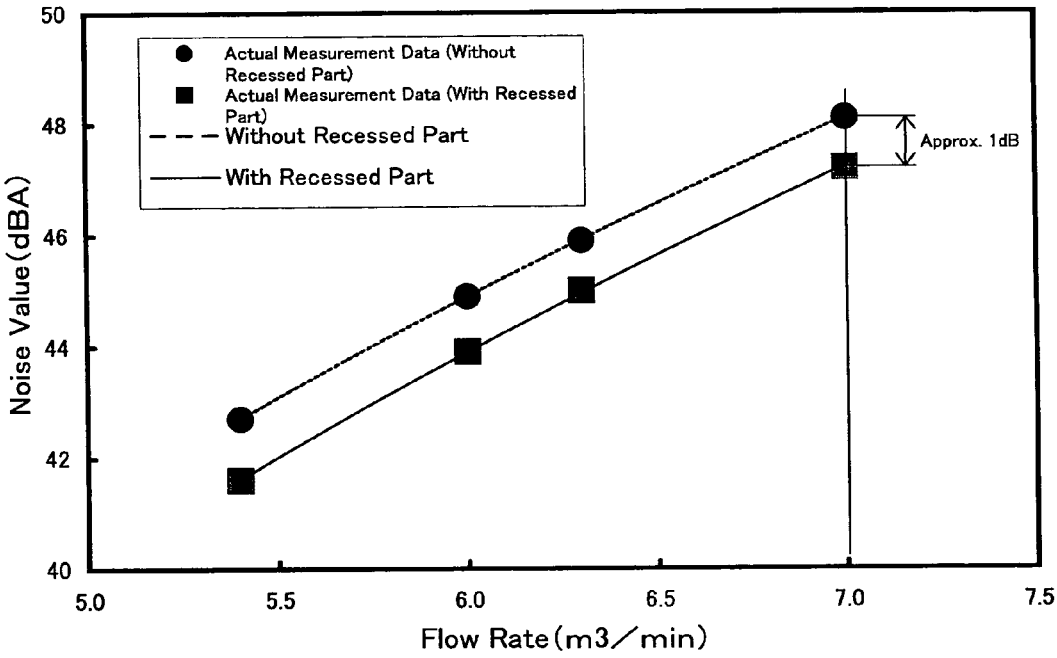
FIG. 8 is an air flow rate characteristics graph that compares the performance of a multi blade fan having a recessed part in the bell mouth and a multi blade fan that does not have a recessed part in the bell mouth.

The results shown in FIG. 8 were obtained upon measuring the gas flow rate and noise value for the two multi blade fans 110 and 210. Therein, the plotted circles and dashed line indicate the experimental data of the multi blade fan 210 (namely, without the recessed part of the bell mouth) for performance comparison, and the plotted squares and solid line indicate the experimental data of the multi blade fan 110 of the present embodiment (namely, with the recessed part of the bell mouth).

According to the results of the experiment, the noise value for the multi blade fan 110 of the present embodiment was approximately 1 dB lower than the multi blade fan 210 for performance comparison, under the same gas flow rate conditions (e.g., a gas flow rate of 7 $m^3$/min) (same results obtained even with other gas flow rate conditions), thus demonstrating superior noise performance. As explained above, this is thought to be caused by the reduction in turbulence in the flow in the vicinity of the inlet due to the provision of the recessed part in the bell mouth.

In addition, the rotational speed of the impeller under the identical gas flow rate conditions was less for the multi blade fan 110, e.g., when the gas flow rate was 7 $m^3$/min, the rotational speed was 754 $min^{-1}$ for the multi blade fan 110 and 783 $min^{-1}$ for the multi blade fan 210 (and the same result was obtained even under other gas flow rate conditions). Consequently, it was shown that the motor drive needed to obtain the same gas flow rate was less for the multi blade fan 110 having the recessed part in the bell mouth compared with the multi blade fan 210 without the recessed part in the bell mouth, thus demonstrating that the multi blade fan 110 also had superior ventilation performance.

Based on the above, improved noise performance and ventilation performance can be achieved if the bell mouth 112 is provided with a recessed part 112*d*, as in the multi blade fan 110 of the present embodiment.

(4) Modified Example

Figure 9:
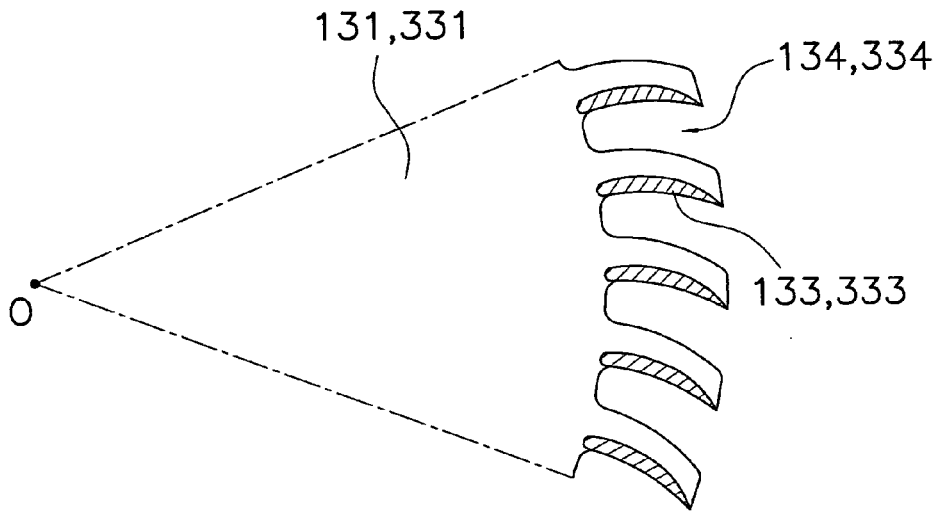
FIG. 9 is a cross sectional view taken along H—H in FIG. 3, FIG. 11, and FIG. 15.

In the multi blade fan 110 of the present embodiment, it is also acceptable to cut out at least the blade 133 front part in the rotational direction of each interblade part 134 positioned between each of the plurality of blades 133 of the main plate 131 of the impeller 113, as shown in FIG. 9.

Figure 10:
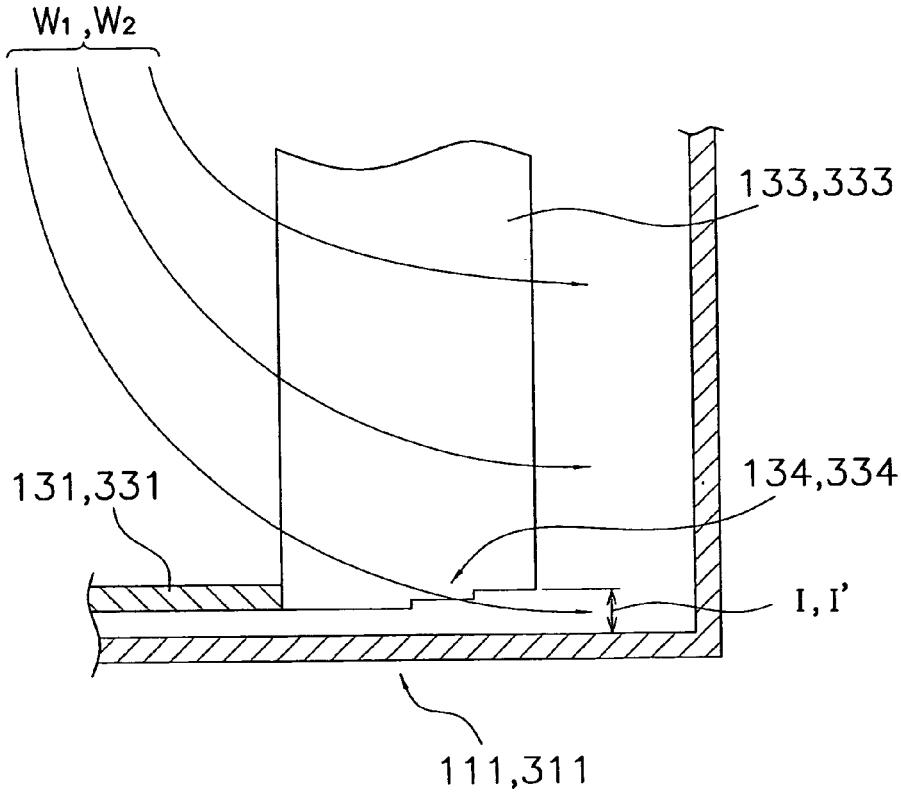
FIG. 10 is a view that explains the flow of the gas in the interblade parts of the impeller.

Thereby, as shown in FIG. 10, gas also flows in the gap I between the main plate 131 and the housing 111 through the interblade parts 134. Thereby, it is possible to take sufficient advantage of the volume of the space of the housing 111.

Second Embodiment

Providing the bell mouth 112 with the recessed part 112*d* in the multi blade fan 110 of the first embodiment prevents the breaking away of the flow of gas that flows into the inlet 112*a* along the bell mouth 112 (the wall surface flow), thus reducing turbulence in the flow; however, in addition, it is also preferable to reduce turbulence in the flow created when the wall surface flow merges with the main flow.

Figure 11:
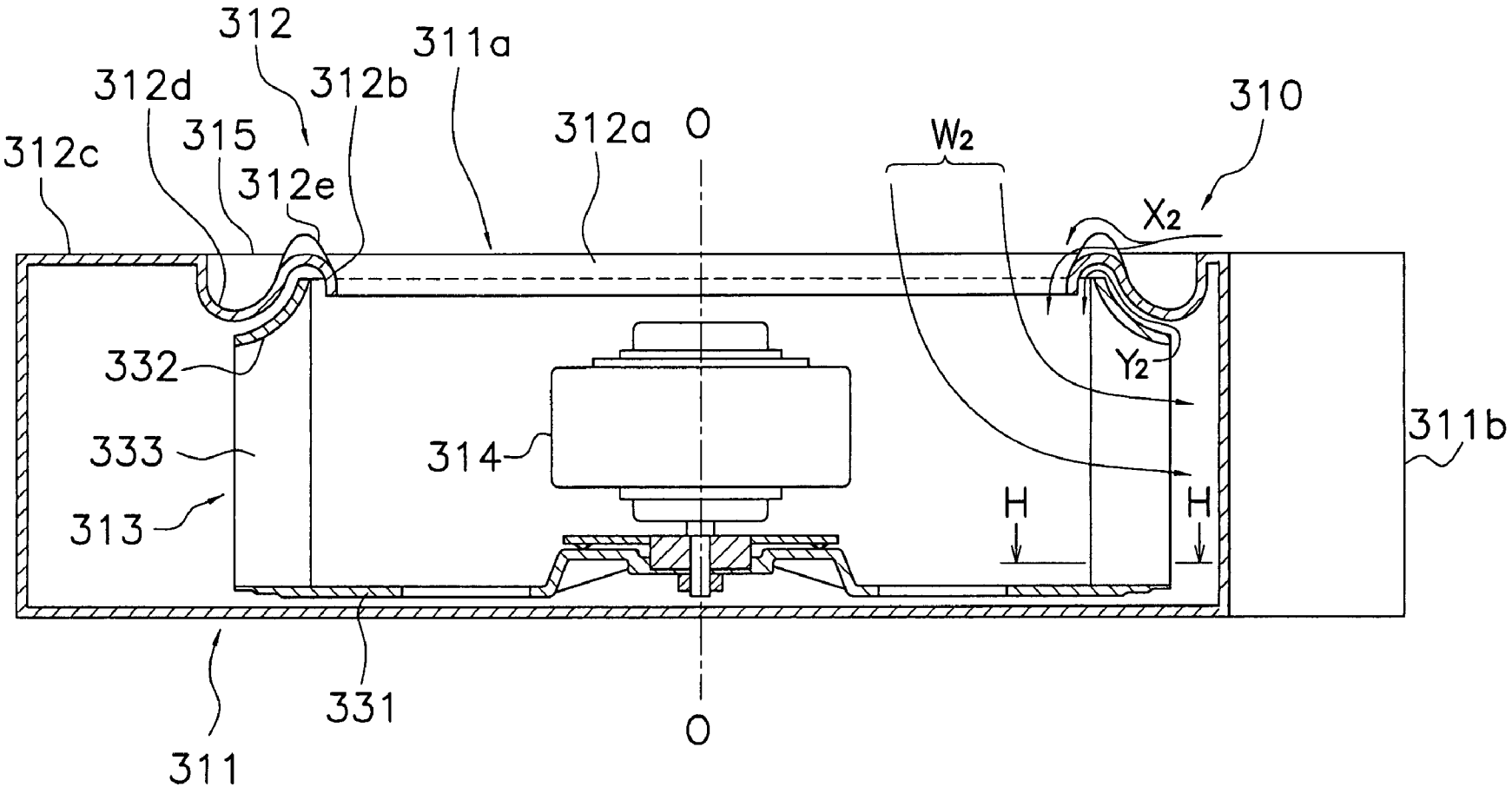
FIG. 11 is a side view (cross sectional view taken along A—A in FIG. 12) of the multi blade fan according to the second embodiment of the present invention.

Accordingly, in a multi blade fan 310 of the present embodiment, a plurality of protruding parts 312*e* are provided in the connecting portion between a curved part 312*b* and a recessed part 312*d* of the bell mouth, i.e., on the downstream side of the flow of the recessed part 312*d*, as shown in FIG. 11. The following explains the multi blade fan 310 of the present embodiment, using the drawings.

(1) Constitution of the Multi Blade Fan

Figure 12:
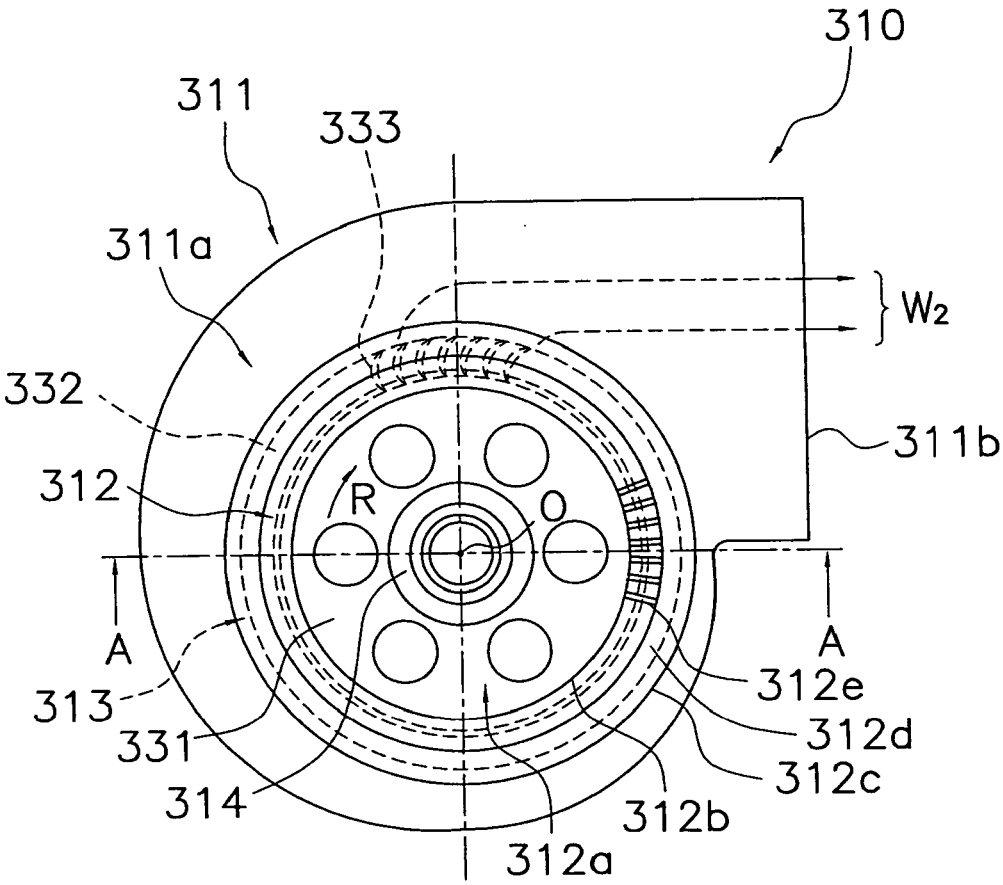
FIG. 12 is a plan view of the multi blade fan according to the second embodiment of the present invention.

FIG. 11 depicts a side view (specifically, a cross sectional view taken along A—A in FIG. 12) of the multi blade fan 310 according the second embodiment, and FIG. 12 depicts a plan view of the multi blade fan 310.

The same as the multi blade fan 110 of the first embodiment, the multi blade fan 310 comprises an impeller 313, a housing 311 that houses the impeller 313, a motor 314 for rotating the impeller 313, and the like. Further, the axis O—O in FIG. 11 and FIG. 12 is the rotational axis line of the impeller 313 and the motor 314.

The same as the impeller 113 of the first embodiment, one end of [each of] the numerous blades 333 (only some of the numerous blades 333 are illustrated in FIG. 12) of the impeller 313 is fixed to the outer circumferential edge of a discoidal main plate 331, and the other end of [each of] those blades 333 is connected by an annular side plate 332.

The same as the housing 111 of the first embodiment, the housing 311 is a scroll shaped box body from a plan perspective, and comprises an opening 311*a* and a gas outlet 311*b*.

The same as the bell mouth 112 of the first embodiment, a bell mouth 312 is arranged so that it covers the opening 311*a* of the housing 311, and an inlet 312*a* is formed therein for guiding the inlet gas to the impeller 313. The inlet 312*a* is arranged so that it opposes the side plate 332 of the impeller 313. Furthermore, in the present embodiment, the bell mouth 312 has a shape different from that of the bell mouth 112 of the multi blade fan 110 of the first embodiment, and comprises the plurality of protruding parts 312*e* in addition to the recessed part 312*d*. Specifically, the plurality of protruding parts 312*e* are arranged in the connecting portion between the curved part 312*b* and the recessed part 312*d* and are aligned spaced apart in the circumferential direction of the inlet 312*a*, as shown in FIG. 11 and FIG. 12, and are formed so that they protrude from the connecting portion between the curved part 312*b* and the recessed part 312*d* toward the side opposite the impeller 313. In addition, the plurality of protruding parts 312*e* are radially arranged so that they oppose the recessed part 312*d* annularly provided around the inlet 312*a* (only some of the plurality of protruding parts 312*e* are illustrated in FIG. 12).

Figure 13:
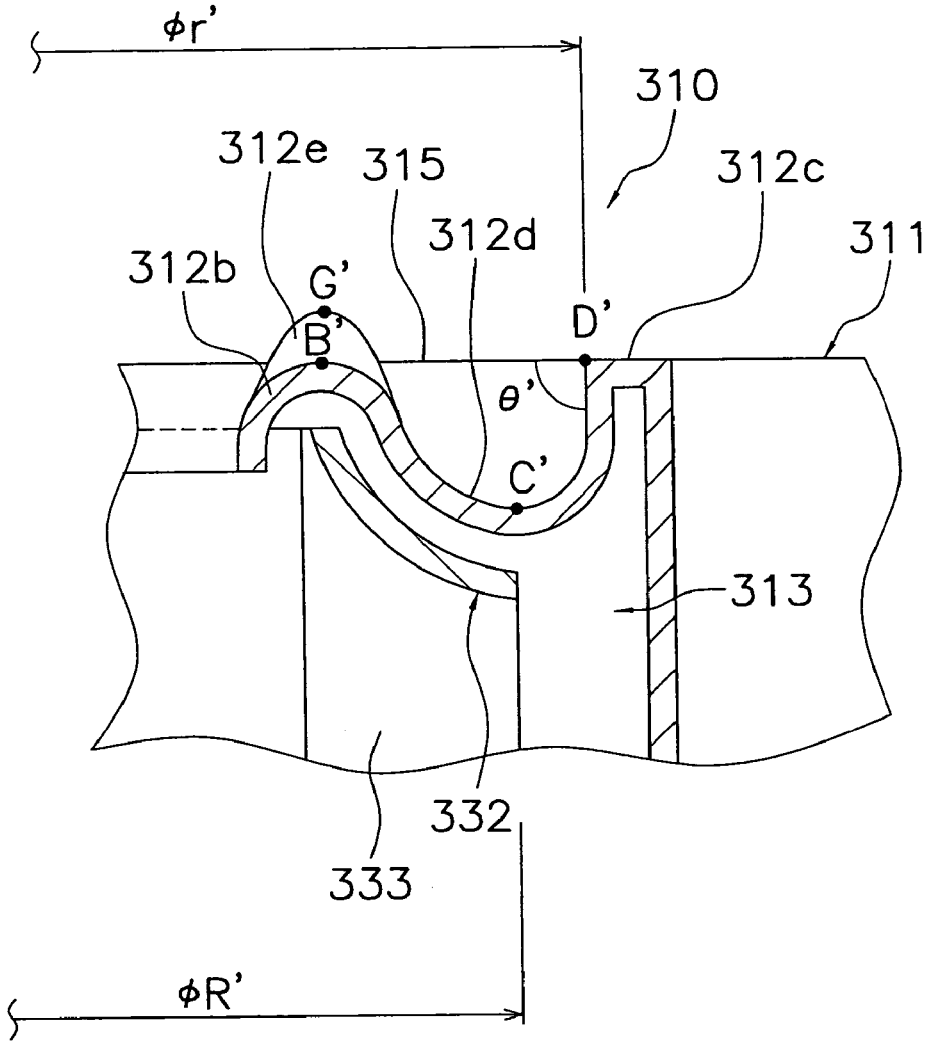
FIG. 13 is an enlarged view of FIG. 11, and depicts the vicinity of the recessed part of the bell mouth of the multi blade fan.

The following explains in detail the structure in the vicinity of the recessed part 312*d* of the bell mouth 312 of the multi blade fan 310, using FIG. 13. Further, FIG. 13 is an enlarged view of FIG. 11, and depicts the vicinity of the recessed part 312*d* of the bell mouth 312 of the multi blade fan 310.

Further, the same as for the bell mouth 112 of the first embodiment, if we let the connecting portion between the curved part 312*b* and the recessed part 312*d* (in detail, the surface of this portion on the side opposite the impeller 313) be point B', the portion of the recessed part 312*d* that is most recessed on the impeller 313 side (in detail, the surface of this portion on the side opposite the impeller 313) be point C', and the connecting portion between a flat part 312*c* and the recessed part 312*d* (in detail, the surface of this portion on the side opposite the impeller 313) be point D', then the point C' is positioned on the impeller 313 side of the point B' and the point D'.

In addition, in the present embodiment the same as the first embodiment, the ratio of the length $\phi r'$ from the rotational axis line O—O to the point D' with respect to the outer radius $\phi R'$ of the impeller 313, i.e., the length ratio $\phi r'/\phi R'$, is greater than or equal to 0.8, and less than 1.4.

In addition, in the present embodiment the same as the first embodiment, a plane 315 formed by virtually linking the point B' and the point D' is substantially orthogonal to the rotational axis line O—O, and is positioned in a plane identical to the surface of the flat part 312*c* on the side opposite the impeller 313. Consequently, the flow of the gas when passing through the vicinity of the recessed part 312*d* (the wall surface flow) is such that it does not become turbulent.

In addition, in the present embodiment the same as in first embodiment, the angle $\theta'$ formed at the point D' by the plane formed on the side opposite the impeller 313 by virtually extending the flat part 312*c* to the inner circumferential side (in the present embodiment, the plane the same as the plane 315) and the plane extending from the point C' to the point D' is greater than 60° and less than 90°.

In addition, the surface on the impeller 313 side of the recessed part 312*d* of the bell mouth 312 (particularly the surface corresponding to that between the point B' and the point C') has a shape that follows along the shape of the side plate 332, the same as the first embodiment. In other words, by forming the recessed part 312*d* in the bell mouth 312, the shape that follows along the side plate 332 is formed in the bell mouth 312.

Furthermore, the same as the first embodiment, the end part on the impeller 313 side of the curved part 312*b* of the bell mouth 312 is arranged on the inner circumferential side in the radial direction of the end part on the inlet 312*a* side of the side plate 332, and is arranged so that it overlaps the end part on the inlet 312*a* side of the side plate 332 in the rotational axis line O—O direction.

The portion of each protruding part 312*e* that protrudes most on the side opposite the impeller 313 (the point G') is positioned more on the side opposite the impeller 313 than the point D'. In addition, the protruding part 312*e* is provided so that it smoothly joins the curved part 312*b* and the recessed part 312*d*.

Furthermore, the same as the first embodiment, in the multi blade fan 310 of the present embodiment, the portion where the axial dimension of the housing 311 decreases is limited only to the portion where the recessed part 312*d* is provided, and the portion where the volume of the space inside the housing 311 decreases is therefore as small as possible.

(2) Operation of the Multi Blade Fan

Figure 14:
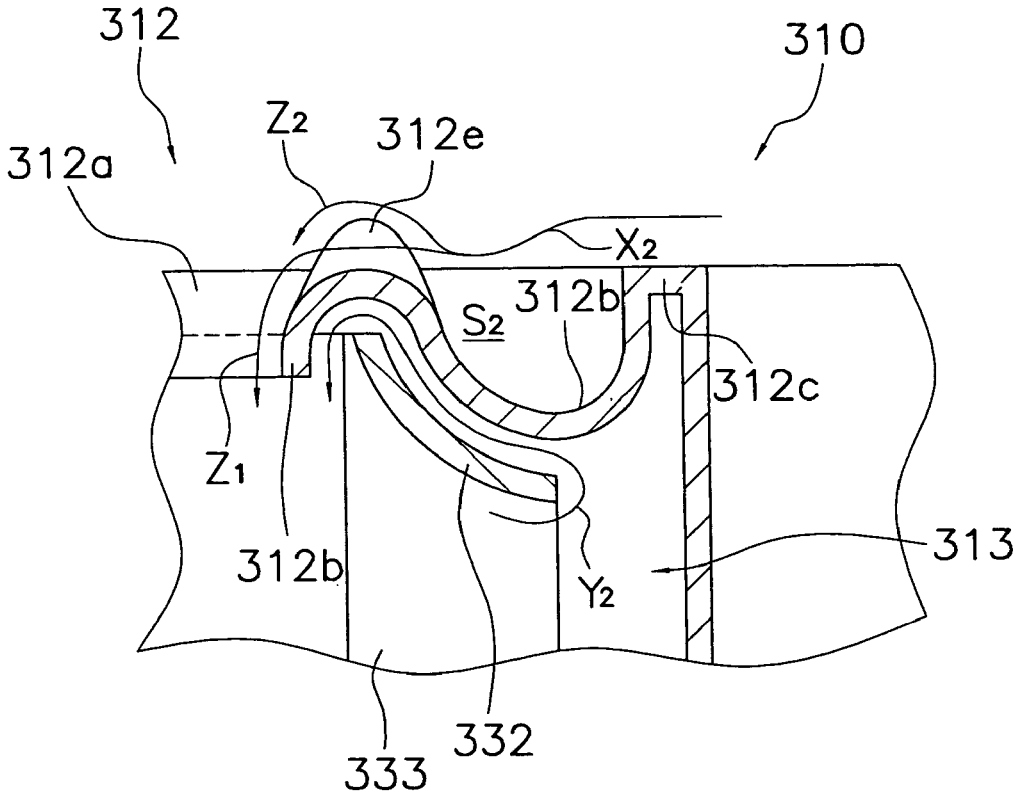
FIG. 14 is an enlarged view of FIG. 11, and explains the wall surface flow and the turning flow in the vicinity of the recessed part of the bell mouth.

The following explains the operation of the multi blade fan 310, using FIG. 11, FIG. 12, and FIG. 14. Further, FIG. 14 is an enlarged view of FIG. 11, and explains the wall surface flow and the turning flow in the vicinity of the recessed part 312*d* of the bell mouth 312.

If the multi blade fan 310 is operated by driving the motor 314, then the impeller 313 rotates oriented in the rotational direction R of FIG. 12 with respect to the housing 311. Thereby, all of the blades 333 of the impeller 313 increase the pressure of and blow out the gas from the space on the inner circumferential side to the space on the outer circumferential side, take gas from the inlet 312*a* into the space on the inner circumferential side of the impeller 313, and collect and blow out the gas blown out to the outer circumferential side of the impeller 313 to the outlet 311*b*. Namely, the same as the multi blade fan 110 of the first embodiment, the multi blade fan 310 takes gas in from the rotational axis O—O direction, as shown by the arrow $W_2$ depicted in FIG. 11 and FIG. 12, and blows the gas out from the outlet 311*b*.

Further, the wall surface flow and the turning flow of the gas in the vicinity of the inlet 312*a* and the bell mouth 312 are as shown in FIG. 11 and FIG. 14.

The same as in the first embodiment, when the wall surface flow (the arrow $X_2$ in the figure) passes through the vicinity of the recessed part 312*d*, it flows along the bell mouth 312 without breaking away because it flows so that it is drawn into a space $S_2$ formed by the provision of the recessed part 312*d*.

Next, a portion of the wall surface flow $X_2$ that passed through the vicinity of the recessed part 312*d* (the arrow $Z_2$ in the figure) flows along the protruding parts 312*e*, and the remainder flows as is along the curved part 312*b* between protruding parts 312*e*. Furthermore, the gas $Z_2$ that flows along the protruding parts 312*e* smoothly merges with a main flow $W_2$ without any turbulence because its line of flow substantially coincides with the line of flow of the main flow (the arrow $W_2$ in FIG. 11) that flows into the inlet 312*a* along the rotational axis line O—O. However, the gas $Z_1$ that flows along the curved part 312*b* merges with the main flow $W_2$ that merged with the gas $Z_2$ flowing along the protruding parts 312*e*, and flows into the inlet 312*a*. Namely, the flow rate of the gas $Z_1$ that flows along the curved part 312*b* is less than the case wherein the protruding parts 312*e* are not formed, as in the first embodiment, and turbulence in the flow due to the merging with the main flow $W_2$ is consequently mitigated.

Moreover, because the point G' is positioned more on the side opposite the impeller 313 than the point D', the portion of the wall surface flow $X_2$ that tries to flow into the inlet 312*a* along the flat part 312*c* of the bell mouth 312 can be reliably guided to the protruding parts 312*e* side.

Thereby, further reducing turbulence in the wall surface flow $X_2$ in the vicinity of the inlet 312*a* enables the advantageous effects of reducing the noise and improving the ventilation performance, the same as the first embodiment, and also enables a reduction in noise due to the merging of the main flow $W_2$ and the wall surface flow $X_2$, and an improvement in the ventilation performance.

(3) Modified Example

In the multi blade fan 310 of the present embodiment, the same as the first embodiment, it is also acceptable to cut out at least the blade 333 front part in the rotational direction of each interblade part 334 positioned between each of the plurality of blades 333 of the main plate 331 of the impeller 313, as shown in FIG. 9.

Thereby, as shown in FIG. 10, gas also flows in the gap I' between the main plate 331 and the housing 311 through the interblade parts 334. Thereby, it is possible to take sufficient advantage of the volume of the space of the housing 311.

Third Embodiment

Figure 1:
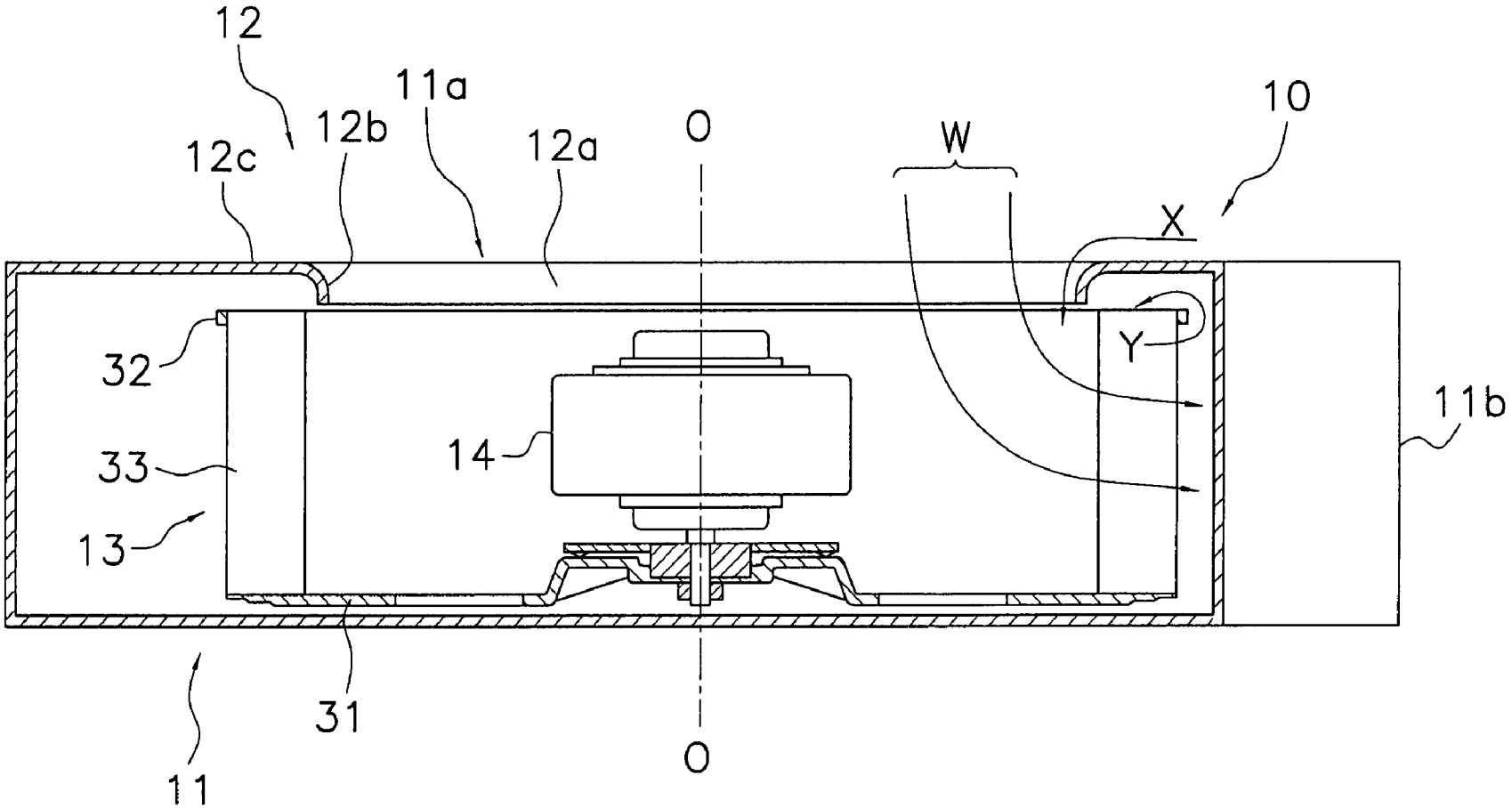
FIG. 1 is a side view (cross sectional view taken along A—A in FIG. 2) of a conventional example of a multi blade fan.
Figure 2:
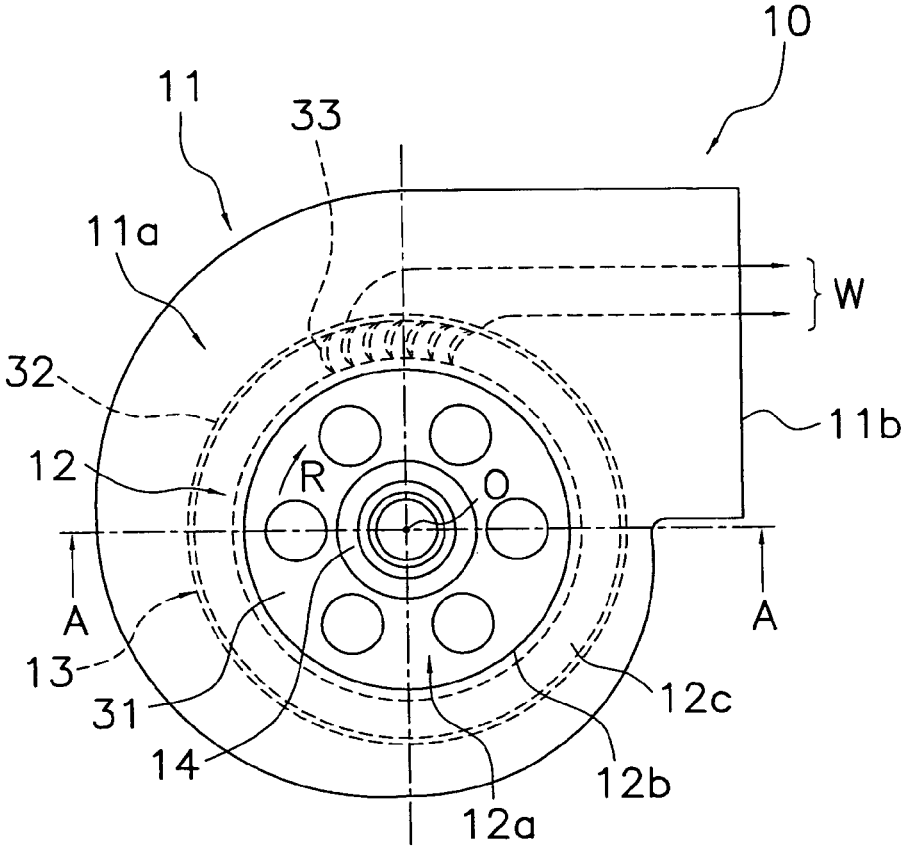
FIG. 2 is a plan view of a conventional example of a multi blade fan.
Figure 15:
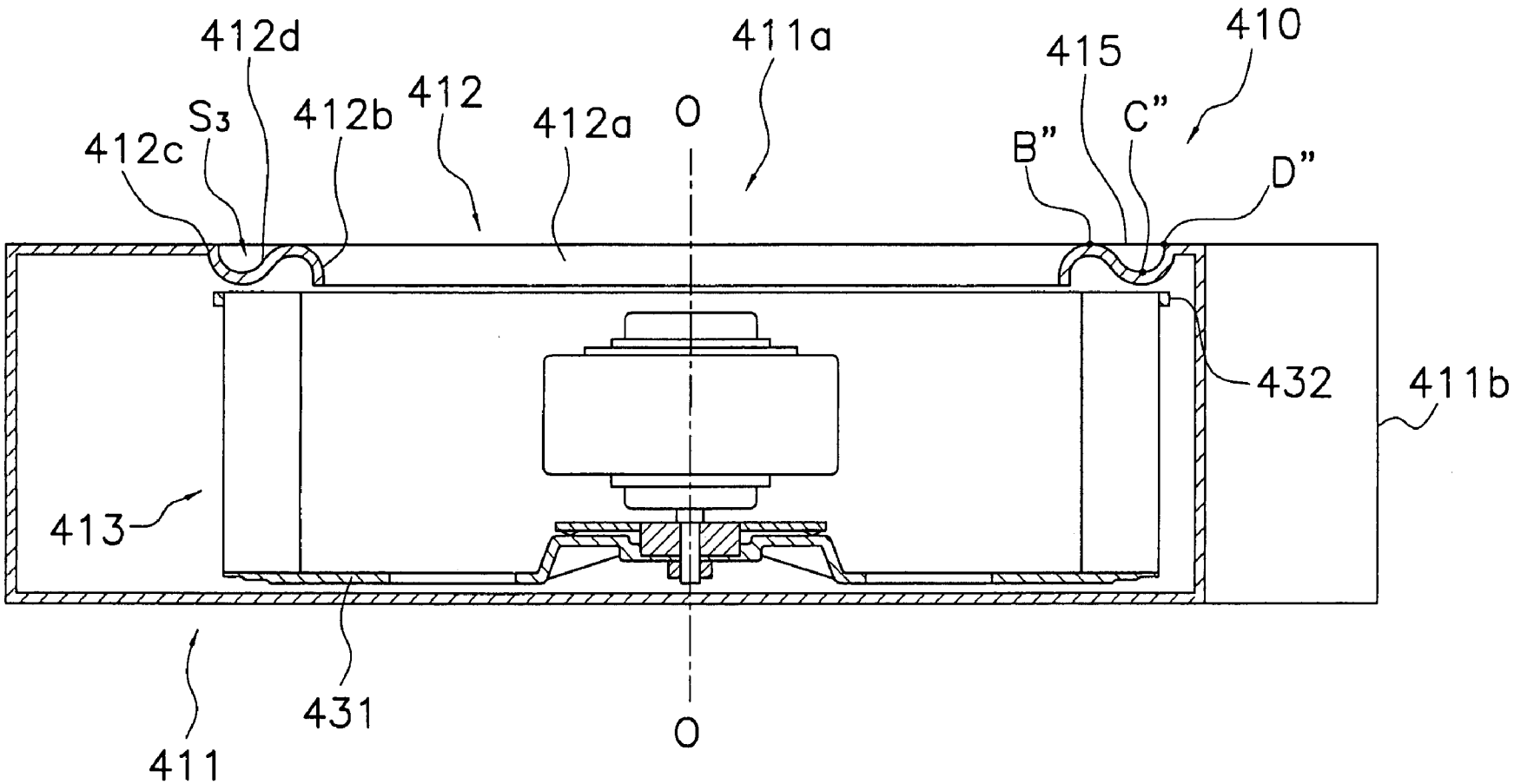
FIG. 15 is a side view of the multi blade fan according to the third embodiment of the present invention, and corresponds to FIG. 3.

Although the multi blade fan 110 of the first embodiment uses as the side plate an annular side plate 132 inclined toward the side opposite the main plate 131 (namely, the side of the inlet 112*a*, discussed later) when proceeding from the outer circumferential edge to the inner circumferential edge, a multi blade fan 410 (refer to FIG. 15) is also acceptable, comprising an impeller 413 that uses a side plate 432 shaped the same as the side plate 32 of the conventional example of the multi blade fan 10 (refer to FIG. 1).

Specifically, the multi blade fan 410 principally comprises an impeller 413 shaped the same as the impeller 13 of the conventional example of the multi blade fan 10, and a bell mouth 412 shaped the same as the bell mouth 112 of the multi blade fan 110 in the first embodiment. In addition, the same as the housing 111 of the first embodiment, the housing 411 is a scroll shaped box body when viewed from a plan perspective, and comprises an opening 411*a* and a gas outlet 411*b*. Furthermore, because the bell mouth 412 is shaped the same as the bell mouth 112 of the multi blade fan 110 of the first embodiment, it comprises an inlet 412*a*, a curved part 412*b*, a recessed part 412*d* that is annularly formed so that it surrounds the inlet 412*a*, and a flat part 412*c*. Herein, the same as the points B, C, D and the plane 115 of the first embodiment, the connecting portion between the curved part 412*b* and the recessed part 412*d* is a point B", the portion of the recessed part 412*d* that is most recessed on the impeller 413 side is a point C", the connecting portion between the flat part 412*c* and the recessed part 412*d* is a point D", and the plane formed by virtually linking the point B" and the point D" is a plane 415.

Even in this case, the same as the multi blade fan 110 of the first embodiment, because the provision of the recessed part 412*d* can change a space $S_3$ to negative pressure, turbulence in the flow in the vicinity of the inlet 412*a* is reduced, thus enabling a reduction in the noise and an improvement in the ventilation performance.

In addition, although not illustrated, it is also acceptable in the bell mouth 412 of the above multi blade fan 410 to provide protruding parts the same as the protruding parts 312*e* of the bell mouth 312 of the second embodiment to further reduce noise and improve the ventilation performance. In addition, although not illustrated, the same as in the first embodiment and the second embodiment, it is also acceptable to cut out at least the blade front part in the rotational direction of each interblade part positioned between [each of] the plurality of blades 433 of a main plate 431 of the impeller 413, thus making it possible to take sufficient advantage of the volume of the space of the housing 411.

Other Embodiments

The above explained embodiments of the present invention based on the drawings, but the specific constitution is not limited to these embodiments, and it is understood that variations and modifications may be effected without departing from the spirit and scope of the invention.

For example, although the abovementioned embodiments adopt the present invention in a multi blade fan comprising an impeller having forward inclined blades, the present invention is not limited thereto, and it is possible to apply the present invention to a centrifugal fan that takes in gas from the rotational axis direction, as in a radial fan, a turbo fan, and the like, and blows the gas out in a direction that intersects the rotational axis.

INDUSTRIAL FIELD OF APPLICATION

The use of the present invention enables the prevention of turbulence in the flow in the vicinity of the inlet in a centrifugal fan that takes in gas from the rotational axis direction and blows the gas out in a direction that intersects the rotational axis.

What is claimed is:

1. A centrifugal fan that takes in gas from a rotational axis direction and blows the gas out in a direction that intersects the rotational axis, comprising:

an impeller that rotates about the rotational axis; and a bell mouth having an inlet arranged so that it opposes said impeller, and a recessed part that forms a recessed negative pressure space around said inlet facing the impeller side, and that guides the inlet gas to said impeller, said bell mouth further having a flat part that extends on the outer circumferential side of said recessed part in the radial direction in a direction that intersects the rotational axis, and a curved part that extends on the inner circumferential side in the radial direction of said recessed part toward the impeller side, and that forms said inlet, the portion of said recessed part that is most recessed on the impeller side being positioned on the impeller side of a connecting portion between said flat part and said recessed part, and being positioned on the impeller side of a connecting portion between said curved part and said recessed part, the rotational axis to the connecting portion between said flat part and said recessed part defining a first length with a length ratio of the first length to an outer radius of said impeller being greater than or equal to 0.8 and less than 1.4.

2. The centrifugal fan as recited in claim 1, wherein said bell mouth further has a plurality of protruding parts arranged in the connecting portion between said curved part and said recessed part and aligned spaced apart in the circumferential direction of said inlet, and that protrude outward on the impeller side of the connecting portion between said curved part and said recessed part.

3. The centrifugal fan as recited in claim 2, wherein a portion of said protruding parts that protrude most on the side opposite the impeller is positioned more on the side opposite the impeller than a connecting portion between said flat part and said recessed part.

4. The centrifugal fan as recited in claim 2, wherein said impeller has a main plate that rotates about the rotational axis, a plurality of blades annularly arranged about the rotational axis and whose end parts on the side opposite the inlet are each fixed to said main plate, and an annular side plate that connects with the end parts on the inlet side of said plurality of blades; and the surface of said recessed part on the impeller side has a shape that follows along said side plate.

5. The centrifugal fan as recited in claim 2, further comprising a scroll shaped housing having an opening formed so that it opposes said impeller and a gas outlet formed on the outer circumferential side, and that houses said impeller;

said bell mouth being arranged so that said inlet opposes said opening of said housing.

6. The centrifugal fan as recited in claim 1, wherein said recessed part is annularly formed to surround said inlet.

7. The centrifugal fan as recited in claim 6, wherein said impeller has a main plate that rotates about the rotational axis, a plurality of blades annularly arranged about the rotational axis and whose end parts on the side opposite the inlet are each fixed to said main plate, and an annular side plate that connects with the end parts on the inlet side of said plurality of blades; and the surface of said recessed part on the impeller side has a shape that follows along said side plate.

8. The centrifugal fan as recited in claim 6, further comprising a scroll shaped housing having an opening formed so that it opposes said impeller and a gas outlet formed on the outer circumferential side, and that houses said impeller;

said bell mouth being arranged so that said inlet opposes said opening of said housing.

9. The centrifugal fan as recited in claim 1, wherein said impeller has a main plate that rotates about the rotational axis, a plurality of blades annularly arranged about the rotational axis and whose end parts on the side opposite the inlet are each fixed to said main plate, and an annular side plate that connects with the end parts on the inlet side of said plurality of blades; and the surface of said recessed part on the impeller side has a shape that follows along said side plate.

10. The centrifugal fan as recited in claim 9, wherein the end part of said curved part on the impeller side is arranged on the inner circumferential side in the radial direction of the end part of said side plate on the inlet side, and is arranged so that it overlaps in the rotational axis direction the end part of said side plate on the inlet side.

11. The centrifugal fan as recited in claim 9, further comprising a scroll shaped housing having an opening formed so that it opposes said impeller, and a gas outlet formed on the outer circumferential side, and that houses said impeller;

said bell mouth being arranged so that said inlet opposes said opening of said housing; and interblade parts positioned between each of said plurality of blades of said main plate are cut out at least at the blade front part in the rotational direction of the blade.

12. The centrifugal fan as recited in claim 1, further comprising a scroll shaped housing having an opening formed so that it opposes said impeller, and a gas outlet formed on the outer circumferential side, and that houses said impeller;

said bell mouth being arranged so that said inlet opposes said opening of said housing.

13. The centrifugal fan as recited in claim 1, wherein an angle formed in the connecting portion between said flat part and said recessed part by a plane formed on the side opposite the impeller by virtually extending said flat part to the inner circumferential side and the surface extending from the portion of said recessed part that is most recessed on the impeller side to the connecting portion between said flat part and said recessed part is greater than 60° and less than 90°.

14. The centrifugal fan as recited in claim 1, wherein the plane formed on the side opposite the impeller by virtually linking the connecting portion between said flat part and said recessed part with the connecting portion between said curved part and said recessed part is substantially orthogonal to the rotational axis.

15. A centrifugal fan that takes in gas from a rotational axis direction and blows the gas out in a direction that intersects the rotational axis, comprising:

an impeller that rotates about the rotational axis; and a bell mouth having an inlet arranged so that it opposes said impeller, and a recessed part that forms a recessed negative pressure space around said inlet facing the impeller side, and that guides the inlet gas to said impeller, said bell mouth further having a flat part that extends on the outer circumferential side of said recessed part in the radial direction in a direction that intersects the rotational axis, and a curved part that extends on the inner circumferential side in the radial direction of said recessed part toward the impeller side, and that forms said inlet, the portion of said recessed part that is most recessed on the impeller side being positioned on the impeller side of a connecting portion between said flat part and said recessed part, and being positioned on the impeller side of a connecting portion between said curved part and said recessed part, an angle formed in the connecting portion between said flat part and said recessed part by a plane formed on the side opposite the impeller by virtually extending said flat part to the inner circumferential side and the surface extending from the portion of said recessed part that is most recessed on the impeller side to the connecting portion between said flat part and said recessed part is being greater than 60° and less than 90°.

16. The centrifugal fan as recited in claim 15, wherein the plane formed on the side opposite the impeller by virtually linking the connecting portion between said flat part and said recessed part with the connecting portion between said curved part and said recessed part is substantially orthogonal to the rotational axis.

17. The centrifugal fan as recited in claim 15, wherein said impeller has a main plate that rotates about the rotational axis, a plurality of blades annularly arranged about the rotational axis and whose end parts on the side opposite the inlet are each fixed to said main plate, and an annular side plate that connects with the end parts on the inlet side of said plurality of blades; and the surface of said recessed part on the impeller side has a shape that follows along said side plate.

18. The centrifugal fan as recited in claim 15, further comprising a scroll shaped housing having an opening formed so that it opposes said impeller and a gas outlet formed on the outer circumferential side, and that houses said impeller;

said bell mouth being arranged so that said inlet opposes said opening of said housing.

19. The centrifugal fan as recited in claim 15, wherein said bell mouth further has a plurality of protruding parts arranged in the connecting portion between said curved part and said recessed part and aligned spaced apart in the circumferential direction of said inlet, and that protrude outward on the impeller side of the connecting portion between said curved part and said recessed part.

20. The centrifugal fan as recited in claim 19, wherein a portion of said protruding parts that protrude most on the side opposite the impeller is positioned more on the side opposite the impeller than a connecting portion between said flat part and said recessed part.

21. The centrifugal fan as recited in claim 15, wherein said recessed part is annularly formed to surround said inlet.

22. The centrifugal fan as recited in claim 15, wherein the end part of said curved part on the impeller side is arranged on the inner circumferential side in the radial direction of the end part of said side plate on the inlet side, and is arranged so that it overlaps in the rotational axis direction the end part of said side plate on the inlet side.

23. The centrifugal fan as recited in claim 22, further comprising a scroll shaped housing having an opening formed so that it opposes said impeller, and a gas outlet formed on the outer circumferential side, and that houses said impeller;

said bell mouth being arranged so that said inlet opposes said opening of said housing; and interblade parts positioned between each of said plurality of blades of said main plate are cut out at least at the blade front part in the rotational direction of the blade.

* * * * *